United States Patent [19]

Baker, III et al.

[11] 4,343,371

[45] Aug. 10, 1982

[54] HYBRID ROCK BIT

[75] Inventors: William Baker, III, Irvine; Lloyd L. Garner, Dana Point; Charles R. Harris, Whittier, all of Calif.

[73] Assignee: Smith International, Inc., Newport Beach, Calif.

[21] Appl. No.: 144,515

[22] Filed: Apr. 28, 1980

[51] Int. Cl.[3] ..... E21B 10/14

[52] U.S. Cl. ..... 175/329; 175/336; 175/374; 175/376

[58] Field of Search ..... 175/329, 336, 374, 376, 175/378

[56] References Cited

U.S. PATENT DOCUMENTS

| | | | |
|---|---|---|---|
| 2,557,302 | 6/1951 | Maydew | 175/329 |
| 2,873,093 | 2/1957 | Hildebrandt et al. | 175/336 |
| 3,066,749 | 12/1962 | Hildebrandt | 175/336 |
| 4,006,788 | 2/1977 | Garner | 175/336 |
| 4,203,496 | 5/1980 | Baker | 175/374 X |

*Primary Examiner*—William F. Pate, III

*Attorney, Agent, or Firm*—Robert G. Upton

[57] ABSTRACT

A hybrid rock bit is disclosed wherein a pair of opposing extended nozzle drag bit legs are positioned adjacent a pair of opposed tungsten carbide roller cones. The extended nozzle face nearest the hole bottom has a multiplicity of diamond inserts mounted therein. The diamond inserts are strategically positioned to remove the ridges between the kerf rows in the hole bottom formed by the inserts in the roller cones.

5 Claims, 4 Drawing Figures

HYBRID ROCK BIT

CROSS-REFERENCE TO RELATED APPLICATIONS

This application relates to a commonly assigned application entitled TWO CONE BIT WITH EXTENDED DIAMOND CUTTERS, filed June 28, 1979, Ser. No. 052,879.

BACKGROUND OF THE INVENTION

1. Field of the Invention

This invention relates to hybrid type rock bits.

More particularly, this invention relates to an extended nozzle multi-cone rock bit with drag bit type diamond cutters positioned in the face of the extended nozzle legs.

2. Description of the Prior Art

Hybrid bits of the type that utilize drilling mud to remove cuttings from the borehole are known in the art.

U.S. Pat. No. 4,006,788, assigned to the same assignee as the present invention, describes a rock bit for recovering core samples as well as rock bit variations for drilling oil wells or the like. In each of the several embodiments described, diamond cutters are strategically mounted on the bit body for cutting rock by a shearing action. Each diamond cutter is in the form of a thin diamond disc bonded to a tungsten carbide stud that is inserted into the bit body. Means are also provided for limiting the depth of penetration of the diamond cutters into the rock formation being drilled. For example, rolling cone cutters with a plurality of tungsten carbide inserts protruding from the surface of the cones limit penetration of the diamond cutters. The protrusion of the carbide inserts is less than the length of the diamond cutting face.

The foregoing patent is disadvantaged in that the multiplicity of diamond cutters placed on the various rock bit embodiments are not positioned to remove the ridges between kerfs left by the rows of tungsten carbide inserts in the roller cones as the cones traverse the bottom of a borehole.

U.S. Pat. No. 3,385,385 describes a roller bit for a large diameter borehole. A plurality of frustoconical cutters are mounted on a bit body, each cutter comprising rows of circumferential spaced-apart tungsten carbide inserts that form kerfs as the cutter traverses the borehole bottom. The same roller cone or cutter defines an intermediate disc-like row to dislodge and breakup the ridges between the kerfs. An alternate cutter apparatus includes a plurality of spaced-apart circumferential inserts positioned between the kerf cutting inserts to remove or breakup the ridges between the kerf rows.

The patent further teaches positioning of inserts at an angle to the web in which the inserts are mounted; each cutter having at least two webs, the angled inserts cutting a wide kerf in the borehole bottom.

A disadvantage with this arrangement of tungsten carbide inserts, while they cut a wide kerf, is the limiting of bit penetration due to relatively large borehole bottom area covered by the inserts in the cones.

Yet another disadvantage of the prior art is the inclusion of cutter elements and formation breaking means in the same cutter cone. Should the cone ball up, no following means is provided to continue bit penetration despite the balled up cone.

The present invention provides a following drag bit leg with diamond inserts so positioned on the face of the drag bit to independently remove the ridges between the deep kerfs cut by the inserts on the adjacent cones.

In addition, with prior art tungsten carbide chisel insert type rock bits, the inserts are typically placed on the cones with their chisel crest or crown oriented radially with respect to the cone to take advantage of the gouging, scraping action typically associated with this type of offset bit. The present invention orients the inner rows of inserts in the cones with their chisel crown circumferentially oriented on the cones so that they cut a narrower, deeper kerf in the borehole bottom, thus allowing the diamond inserts in the drag bit portion of the hybrid bit to work effectively to remove the ridges between the rows of inserts. By orienting the tungsten carbide chisels circumferentially on the cone, the penetration of each insert is deeper, resulting in a faster penetrating rock bit.

SUMMARY OF THE INVENTION

It is an object of this invention to provide a fast, penetrating hybrid rock bit apparatus with a means thereon to remove the ridges between kerf rows in a borehole bottom.

More particularly, it is an object of this invention to provide a fast, penetrating hybrid rock bit having a pair of opposing roller cones with cutting elements extending from and disposed on the surface, such as, tungsten carbide inserts inserted therein, the bit further consisting of a pair of opposing drag bit leg segments on opposite sides of the cutter cones having a plurality of strategically positioned diamond cutting elements extending from and mounted to the surface, such as, diamond inserts inserted in a face of the drag bit leg. The diamond inserts serve to remove the ridges between kerf rows in a borehole bottom.

A hybrid type of rock bit is disclosed wherein one or more roller cones are mounted on journaled legs extending from a bit body with one or more drag bit legs coextending with the roller cone legs. The drag bit legs have a plurality of diamond inserts positioned in a face of the one or more drag bit legs.

Cutter elements are disposed on the surface of the one or more cutter cones, the elements being arranged in circumferential rows about the surface of the cones. The cutter elements, when they contact a borehole bottom, describe substantially concentric kerfs in the borehole bottom that result from removal of detritus material from the bottom. The kerfs define ridges on adjacent sides of the kerfs. Diamond inserts in the face of the one or more drag bit legs are so positioned to remove the ridges on adjacent sides of the kerfs in the borehole bottom.

The tungsten carbide inserts in the cutter cones are, for example, chisel inserts. The ridge or crest of each chisel insert is positioned with their relatively long crests oriented circumferentially thus enabling the inserts to penetrate deeply in the borehole bottom. These circumferentially aligned inserts are preferably those inserts in the inner rows of the cutter cones. The diamond inserts in the adjacent drag bit legs independently remove the ridges left by the deep kerfs in the borehole bottom.

Therefore, an advantage over the prior art is the penetration rates obtained by the hybrid bit of the instant invention by orienting the chisel crest of the inserts circumferentially for deep insert penetration and removing the ridges adjacent the kerfs with diamond inserts in the drag bit legs.

Still another advantage over the prior art is the separation of the kerf-producing function of the roller cones from the ridge-eliminating function of the adjacent drag bit legs.

The above noted objects and advantages of presend invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
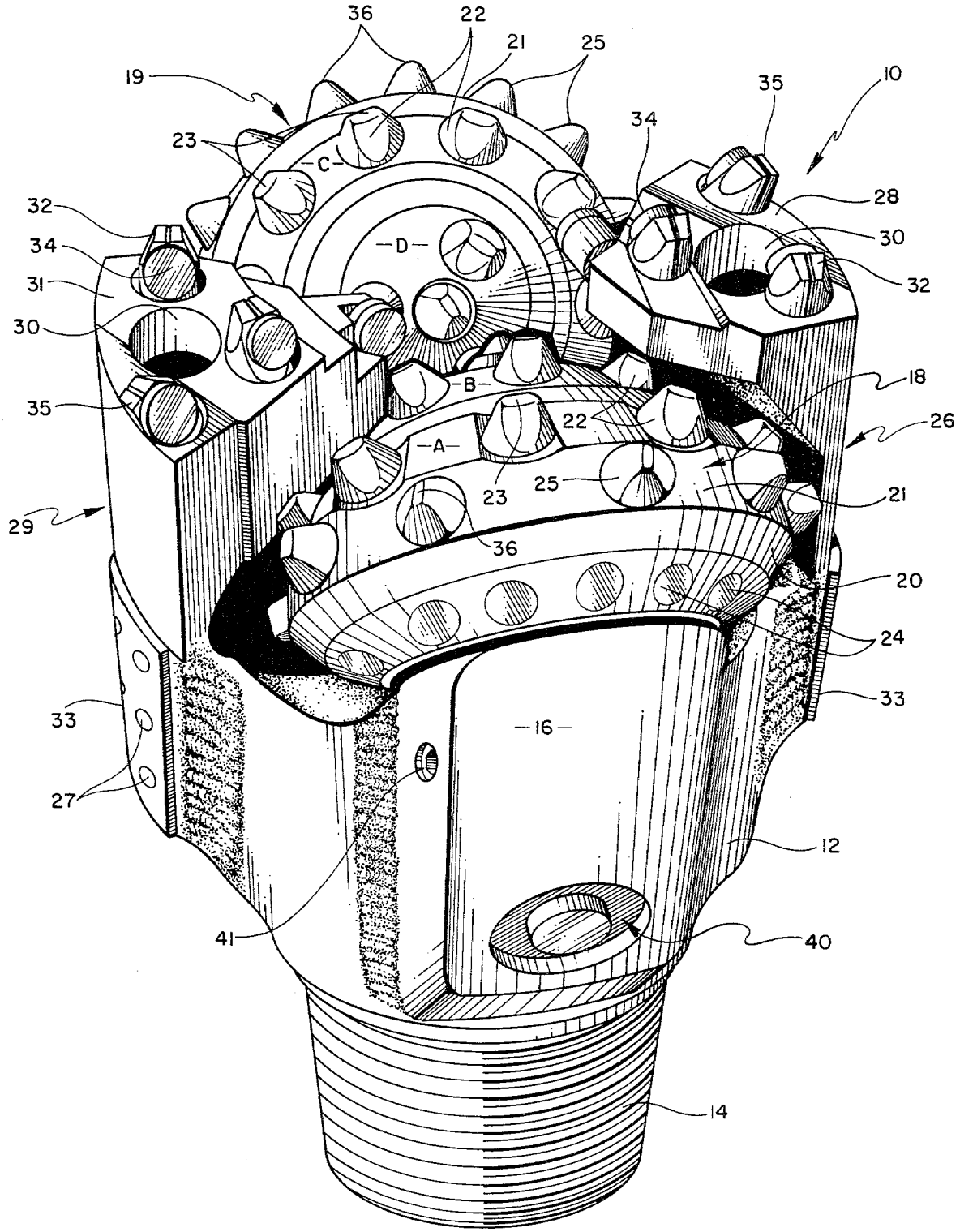
FIG. 1 is a perspetive view of the hybrid rock bit.

Referring now to FIG. 1, the hybrid rock bit, generally designated as 10, consists of a bit body 12 having a pin end 14 at one end and a rock cutting structure at an opposite end. A pair of opposing roller cone legs 16 support roller cones 18 and 19. Adjacent to the roller cones, in an opposing relationship, is a pair of drag bit legs 26 and 29 extending from and welded to the bit body 12. Drag bit legs 26 and 29 terminate in drag bit faces 28 and 31. Hydraulic nozzles or openings are formed in each drag bit face 28 and 31, each opening communicating with a central hydraulic chamber in the rock bit body (not shown). Several diamond insert cutter blanks 32 are strategically positioned in faces 28 and 31, the diamond cutting face 34 of the insert blanks being so oriented to most effectively remove the ridges between kerfs cut by the tungsten carbide inserts in the adjacent cones.

The insert blanks 32, for example, are fabricated from a tungsten carbide substrate with a diamond layer 34 sintered to a face of a substrate, the diamond layer being composed of a polycrystalline material. The synthetic polycrystalline diamond layer is manufactured by the Specialty Material Department of General Electric Company of Worthington, Ohio. The foregoing drill cutter blank is known by the trademark name of Stratapax drill blank.

The cone 18, journaled to leg 16 of bit body 12, has a plurality of chisel type tungsten carbide inserts 22 inserted in the cone. The inserts are equidistantly spaced in each row and the outermost row on the cone is the gage row 21. The chisel crown 36 of gage inserts 25 are oriented in this gage row in a radial direction substantially parallel with the journal axis of the cone. Referring to both cones 18 and 19, the "A", "B", "C" and "D" rows of inner inserts 22 have their chisel crowns oriented in a circumferential direction substantially normal to the journal axis. With this orientation, the chisel crests or crowns 23 tend to penetrate more deeply into the borehole bottom rather than scrape and gouge as would be the normal function of a chisel insert with its crest oriented in a radial direction, especially in an offset type of rock bit.

Figure 2:
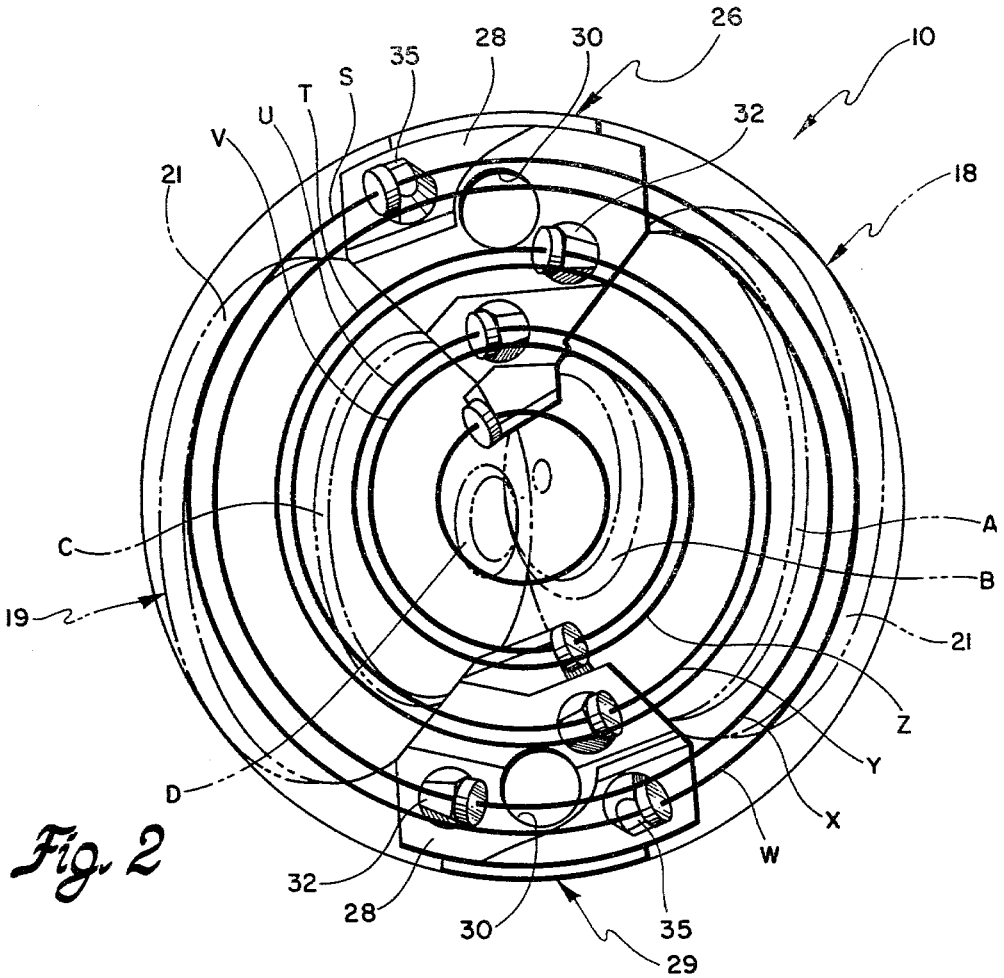
FIG. 2 is an end, semi-schematic view of the hybrid rock bit illustrating the various paths of the tungsten carbide inserts and diamond inserts.

With reference to FIG. 2, as the cones roll on the borehole bottom, the inner inserts 22 in rows "A", "B", "C" and "D" of each of the opposed cones 18 and 19 cut deep, relatively narrow kerfs in the borehole bottom. Ridges then remain adjacent the kerfs. These ridges are removed by the drag bit leg segments 26 and 29. Drag bit face 28 of leg 26 has inserted therein diamond insert blanks 32 with the outermost diamond insert 35 serving to help cut the gage of the borehole (largest diameter of the borehole). The rest of the diamond inserts are so positioned to cut the ridges adjacent the kerfs in the borehole bottom. For example, the inserts in drag bit face 28 cut concentric paths "S", "T", "U" and "V" while the inserts in drag bit face 31 cut concentric paths "W", "X", "Y" and "Z". The drag bit leg segments 26 and 29 then remove all of the ridges left by the deep kerfs cut by the opposed cones 18 and 19. The rock bit combination of drag and roller cone cutters results in a fast, penetrating bit.

Figure 3:
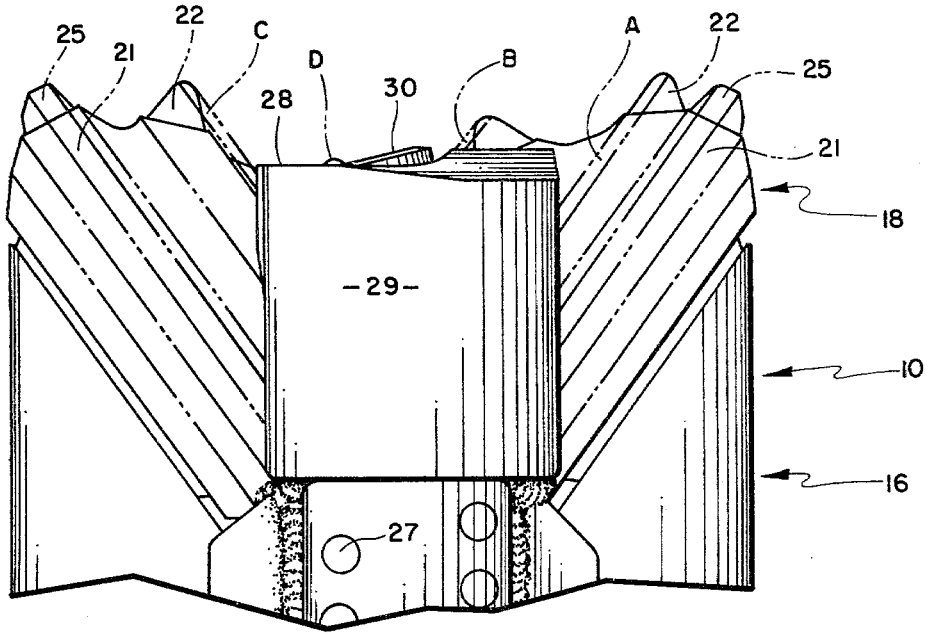
FIG. 3 is a partially cutaway side view of the rock bit.

FIG. 3 best illustrates the circumferential orientation of inner row chisel inserts "A", "B", "C" and "D". The gage row 21 of cones 18 and 19, as stated before, are cut by especially configured chisel type inserts 25 with their crowns 36 oriented radially with respect to the cones since the radial orientation more effectively cuts the gage of the borehole.

The extended drag bit legs 26 and 29 double as extended nozzles, the face 28 defining extended nozzles 30 of each leg. A wear pad 33, with a multiplicity of button type (flush type) tungsten carbide inserts 27 inserted therein, protects the extended drag bit legs. Similar button type inserts 24 protect the gage surface of the cone above the gage row 21 (FIG. 1).

Figure 4:
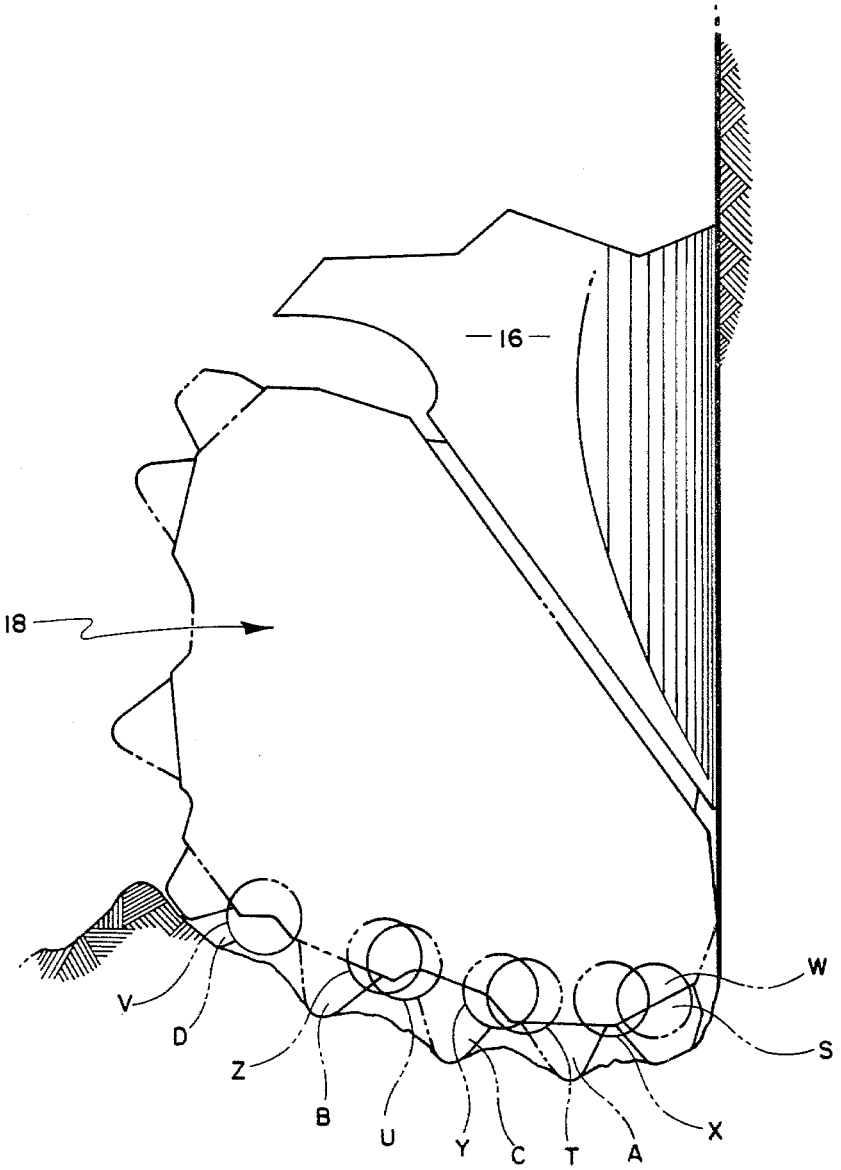
FIG. 4 is a schematic view of one of the cones of the rock bit with the paths of the inserts of the opposing cone and the paths of the diamond inserts of the two drag bit legs of the hybrid bit superimposed on the illustrated cone.

FIG. 4 illustrates schematically a single cone 18 in the bottom of a borehole with the inserts of cone 19 superimposed on cone 18. In addition, each of the diamond inserts of drag bit legs 26 and 29 are superimposed on cone 18, thus clearly indicating the various paths of all the cutting elements of rock bit 10.

The diamond inserts preferably should not extend as far as the tungsten carbide inserts. For example, where a relatively long chisel insert extension is used in inserts 22, the diamond cutting face 34 of the diamond inserts 32 should not extend more than half to three-quarters of the chisel insert extension. To put it another way, if the chisel insert extension is 0.500 of an inch then the diamond insert extension should not extend more than 0.250 to 0.375 of an inch of the 0.500 of an inch tungsten carbide insert. By keeping the cutting surface of the diamond insert recessed from the chisel inserts, the more vulnerable diamond inserts are protected from full penetration of cutting face 34 in the ridges adjacent the kerfs. In addition, at least half of the depth of the chisel inserts will be driven into the borehole bottom without significant interference from the diamond inserts, thereby enhancing bit penetration.

The hybrid rock bit, with its unique orientation of the inner rows of chisel inserts in the cones will advance the bit in the borehole rapidly. The scraping action of the highly efficient diamond inserts that remove the ridges adjacent the kerfs thus assures removal of detritus material from the borehole and unhindered progress of the bit in the hole.

Obviously, the same principles as taught in this invention will apply to a hybrid bit that utilizes milled teeth cones in place of tungsten carbide insert cones. The milled teeth on the inner rows of the milled tooth cone would be oriented with their elongated crowns aligned circumferentially with respect to the cones to effect deeper bit penetration (not shown).

In addition, the hybrid bit could have nonoffset journal alignments or the cones could be offset as shown in FIG. 2. Some skidding will result in the offset bit, however, if the crowns of the chisel inserts (or milled teeth) are oriented circumferentially, as taught by this invention, bit penetration will still be enhanced over state of the art rock bits.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims the invention may be practiced otherwise than as specifically illustrated and described.

We claim:

1. A hybrid rock bit comprising:

a rock bit body having a pin end at a first end and a cutting structure at a second end, said cutting structure consisting of a pair of opposed roller cones mounted to journaled legs extending from said rock bit body, said cutting structure further consisting of a pair of opposed drag bit legs on adjacent sides of said roller cones extending from said body;

a multiplicity of chisel inserts inserted in said roller cones, said inserts being substantially spaced apart and circumferentially positioned in said cones, the chisel crest of each of said multiplicity of chisel inserts mounted inwardly of a plurality of gage row inserts being oriented substantially circumferentially with respect to said roller cones;

a multiplicity of diamond inserts inserted in a face of said drag bit legs, said diamond inserts being so strategically positioned to remove ridges adjacent kerf rows in a borehole bottom; and at least one extended nozzle formed in said face of each of said drag bit legs, said extended nozzle directing fluid toward said borehole bottom during rock bit operation.

2. The invention as set forth in claim 1 wherein said gage row inserts are chisel inserts with the crest of each insert oriented substantially radially with respect to said roller cones.

3. The invention as set forth in claim 1 wherein the diamond insert extension is one-half to three-quarters the extension of said chisel inserts.

4. The invention as set forth in claim 1 wherein the diamond insert extension is about 0.250 to about 0.375 of an inch when said chisel inserts extend about 0.500 of an inch.

5. A hybrid rock bit comprising:

a bit body having a pin end at a first end and one or more legs with cutter cones mounted on journals extending from said legs at a second end of said bit body;

one or more drag bit legs coextending with said cutter cone legs, said drag bit legs having a plurality of diamond cutting elements positioned in a face of said one or more drag bit legs;

chisel insert cutter elements extending from and disposed on the surface of said cutter cones, said elements being arranged in circumferential rows about the surface of said cones, the crest formed by each chisel insert being aligned circumferentially with respect to the cone, said chisel insert cutter elements when contacting a borehole bottom forming substantially concentric kerfs in said borehole bottom resultant from removal of cuttings from said bottom, said kerfs defining ridges on adjacent sides of said kerfs; and said diamond cutting elements positioned in said face of said one or more drag bit legs to substantially remove said ridges formed adjacent said kerfs in said borehole bottom.

* * * * *